US006973901B2

(12) United States Patent
Machida

(10) Patent No.: US 6,973,901 B2
(45) Date of Patent: Dec. 13, 2005

(54) VARIABLE VALVE CONTROL APPARATUS AND METHOD IN INTERNAL COMBUSTION ENGINE

(75) Inventor: Kenichi Machida, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 87 days.

(21) Appl. No.: 10/699,880

(22) Filed: Nov. 4, 2003

(65) Prior Publication Data

US 2004/0094109 A1 May 20, 2004

(30) Foreign Application Priority Data

Nov. 12, 2002 (JP) ..... 2002-328593
Sep. 30, 2003 (JP) ..... 2003-339720

(51) Int. Cl.[7] ..... F01L 1/34
(52) U.S. Cl. ..... 123/90.16; 123/90.15; 123/90.17; 123/406.46; 123/406.59; 123/347; 123/348; 701/105; 701/110
(58) Field of Search ..... 123/90.16, 90.15, 123/90.17, 347, 348, 406.46, 406.59; 701/105, 701/110

(56) References Cited

U.S. PATENT DOCUMENTS 6,513,494 B2 * 2/2003 Kawasaki et al. ..... 123/406.12
6,553,964 B2 * 4/2003 Arai et al. ..... 123/399
6,647,935 B2 * 11/2003 Aoyama et al. ..... 123/90.16
6,769,404 B2 * 8/2004 Aoyama et al. ..... 123/406.29
6,863,048 B2 * 3/2005 Burkhard et al. ..... 123/325

FOREIGN PATENT DOCUMENTS

JP 2001-182563 A 7/2001

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

In an internal combustion engine provided with a variable valve mechanism that varies an open/close characteristic of an intake valve, a target open/close characteristic of the intake valve is determined and at the same time, a control speed of when the intake valve is controlled to have the target open/close characteristic is determined, so that the variable valve mechanism is controlled according to the target open/close characteristic and the control speed.

15 Claims, 12 Drawing Sheets

VARIABLE VALVE CONTROL APPARATUS AND METHOD IN INTERNAL COMBUSTION ENGINE

BACKGROUND

The present invention relates to a variable valve control apparatus and method for controlling an opening/closing characteristic of an intake valve in an internal combustion engine.

Heretofore, there has been known a technology in which there is provided a variable valve control apparatus constituted to successively vary a valve lift amount of an intake valve. A so-called non-throttle control is performed for controlling an intake air amount so as to obtain an optimum engine torque according to operating conditions (Japanese Unexamined Patent Publication No. 2001-182563).

In the case where the intake air amount control is performed by varying the lift amount of the intake valve as described above, different from the intake air amount control by a throttle valve, since there is no influence of a delay in intake air filling due to collector capacity, it is possible to obtain a very quick engine torque response to an operation of accelerator by a driver.

However, if the response to the operation of accelerator is too quick, the engine behaves in response to even a small operation of accelerator. Therefore, at the sudden starting/accelerating time (or at the time of when a driver who is inexperienced in driving operates the accelerator), as the engine power is changed immediately in response to the operation of accelerator, it is impossible to obtain a good drivability that corresponds to a driver's request.

SUMMARY

The present invention has been accomplished in view of the above problem, and has an object of enabling good drivability in an intake air amount control by an intake valve.

To achieve the above object, the present invention is constituted to change a control speed of an intake valve according to engine operating conditions.

The other objects and features of this invention will become understood from the following description with reference to the accompanying drawings.

BRIEF EXPLANATION OF THE DRAWINGS

FIGS. 7A and 7B are cross-sectional views that show an operation of the variable valve event and lift mechanism at a high lift condition (B—B cross section view of FIG. 3).

FIGS. 12A and 12B are graphs that show response characteristics of volume efficiencies in a throttle control and an intake valve control, in which FIG. 12A shows the response characteristic at the time of low speed, and FIG. 12B shows the response characteristic at the time of high speed.

DETAILED DESCRIPTION

Embodiments of the present invention will be described based on the drawings.

Figure 1:
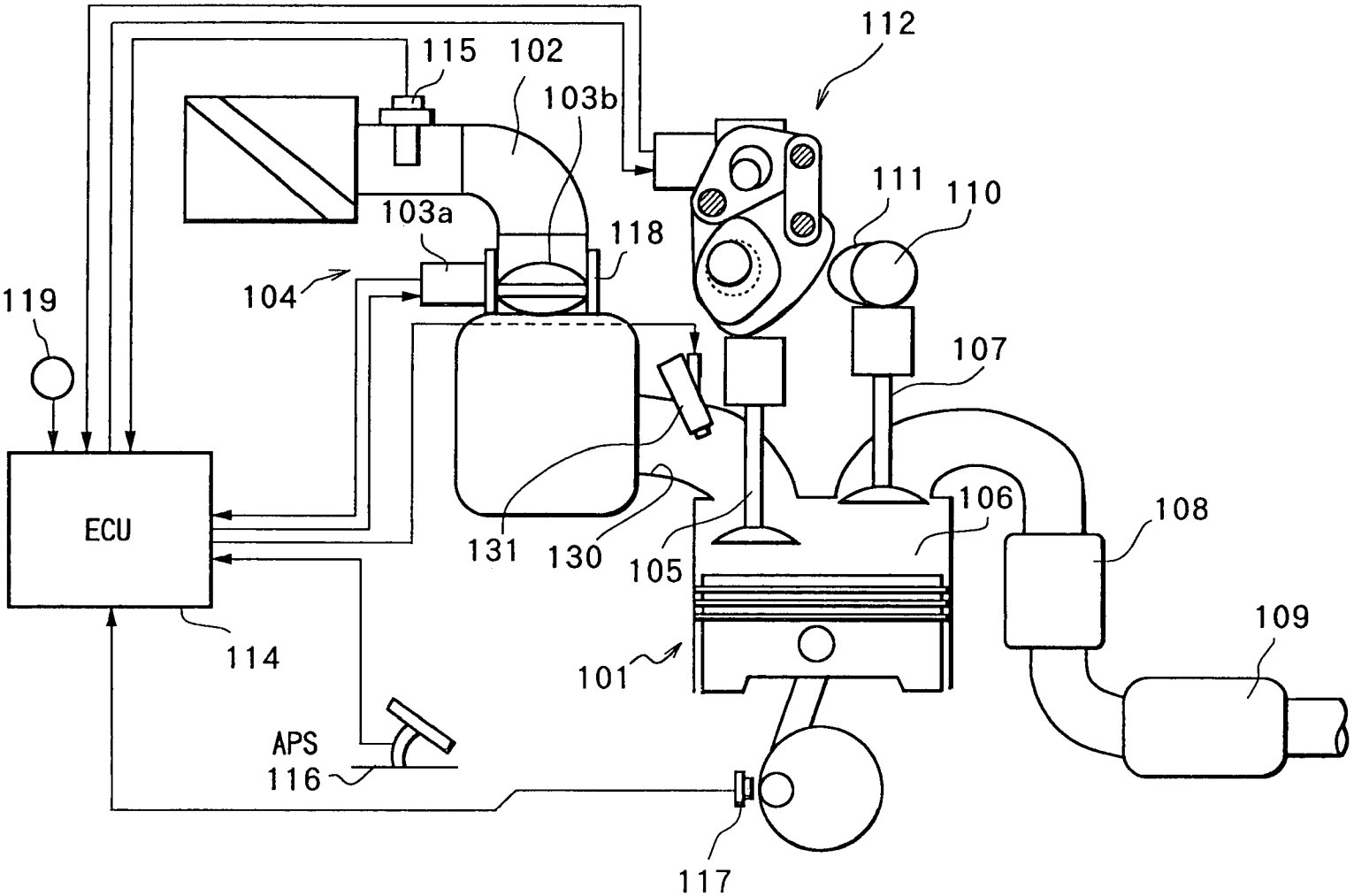
FIG. 1 is a diagram of a system structure of an internal combustion engine.

FIG. 1 is a structural diagram of an internal combustion engine for vehicle in the embodiment. In an intake passage 102 of an internal combustion engine 101, an electronically controlled throttle 104 is disposed for driving a throttle valve 103*b* to open and close by a throttle motor 103*a*. Air is sucked into a combustion chamber 106 via electronically controlled throttle 104 and an intake valve 105.

A combusted exhaust gas is discharged from combustion chamber 106 via an exhaust valve 107, purified by a front catalyst 108 and a rear catalyst 109, and then emitted into the atmosphere.

Exhaust valve 107 is driven to open and close while maintaining a valve lift amount and a valve operating angle thereof by a cam 111 axially supported by an exhaust side camshaft 110. On the contrary, a valve lift amount and a valve operating angle of intake valve 105 are varied successively by a variable valve event and lift mechanism 112. Note, the valve lift amount and the valve operating angle are varied simultaneously, so that, when a characteristic of one of the valve lift amount and the valve operating angle is determined, a characteristic of the other is also determined.

A control unit 114 incorporating therein a microcomputer, controls electronically controlled throttle 104 and variable valve event and lift mechanism 112 according to an accelerator pedal opening detected by an accelerator pedal sensor APS 116, so that a target intake air amount corresponding to an accelerator opening ACC can be obtained by an opening of throttle valve 103*b* and an opening/closing characteristic of intake valve 105.

Control unit 114 receives various detection signals from an air flow meter 115 detecting an intake air amount Q of engine 101, a crank angle sensor 117 taking out a rotation signal from a crankshaft, a throttle sensor 118 detecting an opening TVO of throttle valve 103*b*, a water temperature sensor 119 detecting a cooling water temperature Tw of engine 101, and the like, in addition to accelerator pedal sensor APS 116.

Further, an electromagnetic fuel injection valve 131 is disposed on an intake port 130 at the upstream side of intake valve 105 of each cylinder. Fuel injection valve 131 injects fuel adjusted at a predetermined pressure toward intake valve 105 when driven to open by an injection pulse signal from control unit 114.

Figure 2:
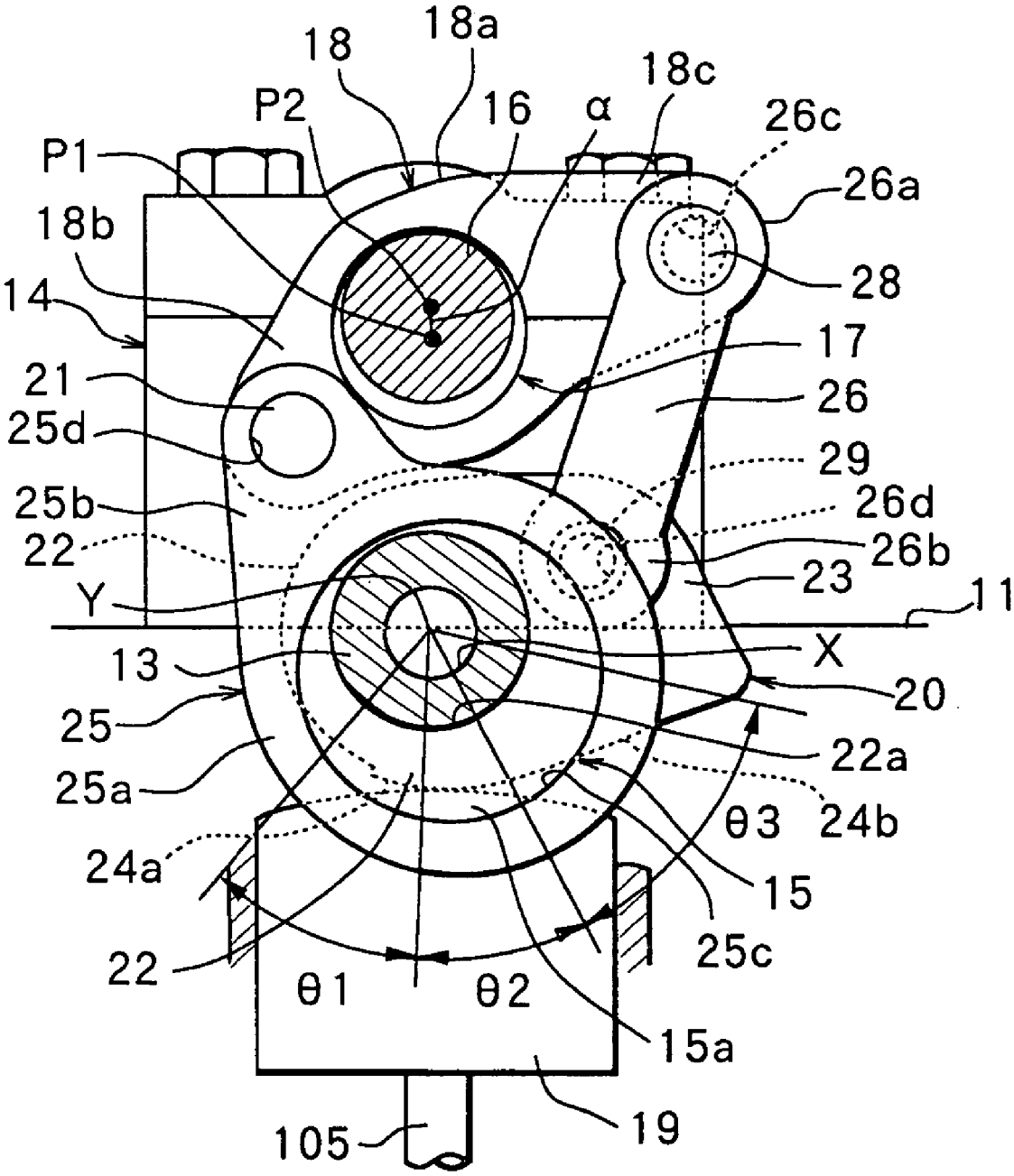
FIG. 2 is a cross-sectional view that shows a variable valve event and lift mechanism (A—A cross section of FIG. 3).
Figure 3:
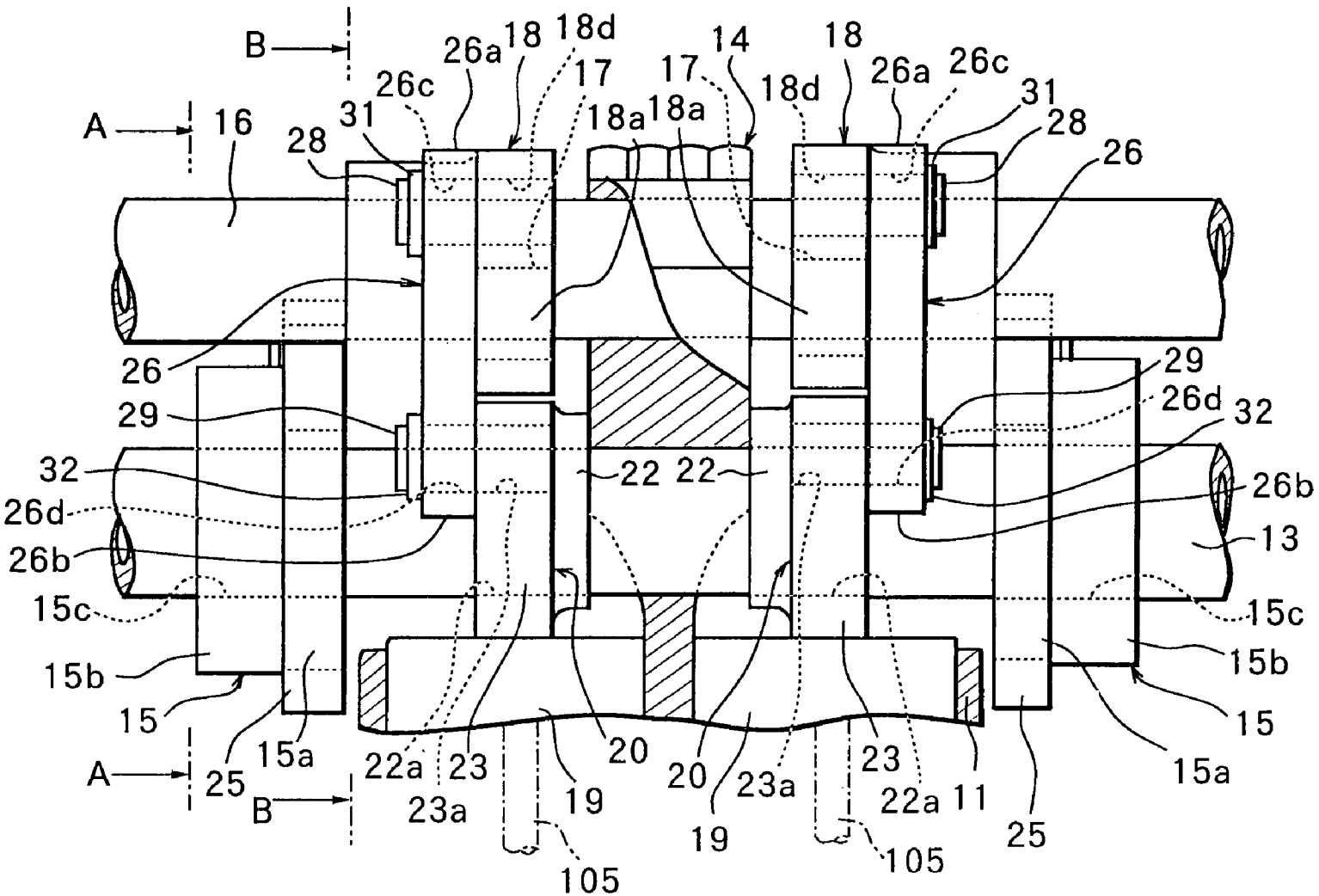
FIG. 3 is a side elevation view of the variable valve event and lift mechanism.
Figure 4:
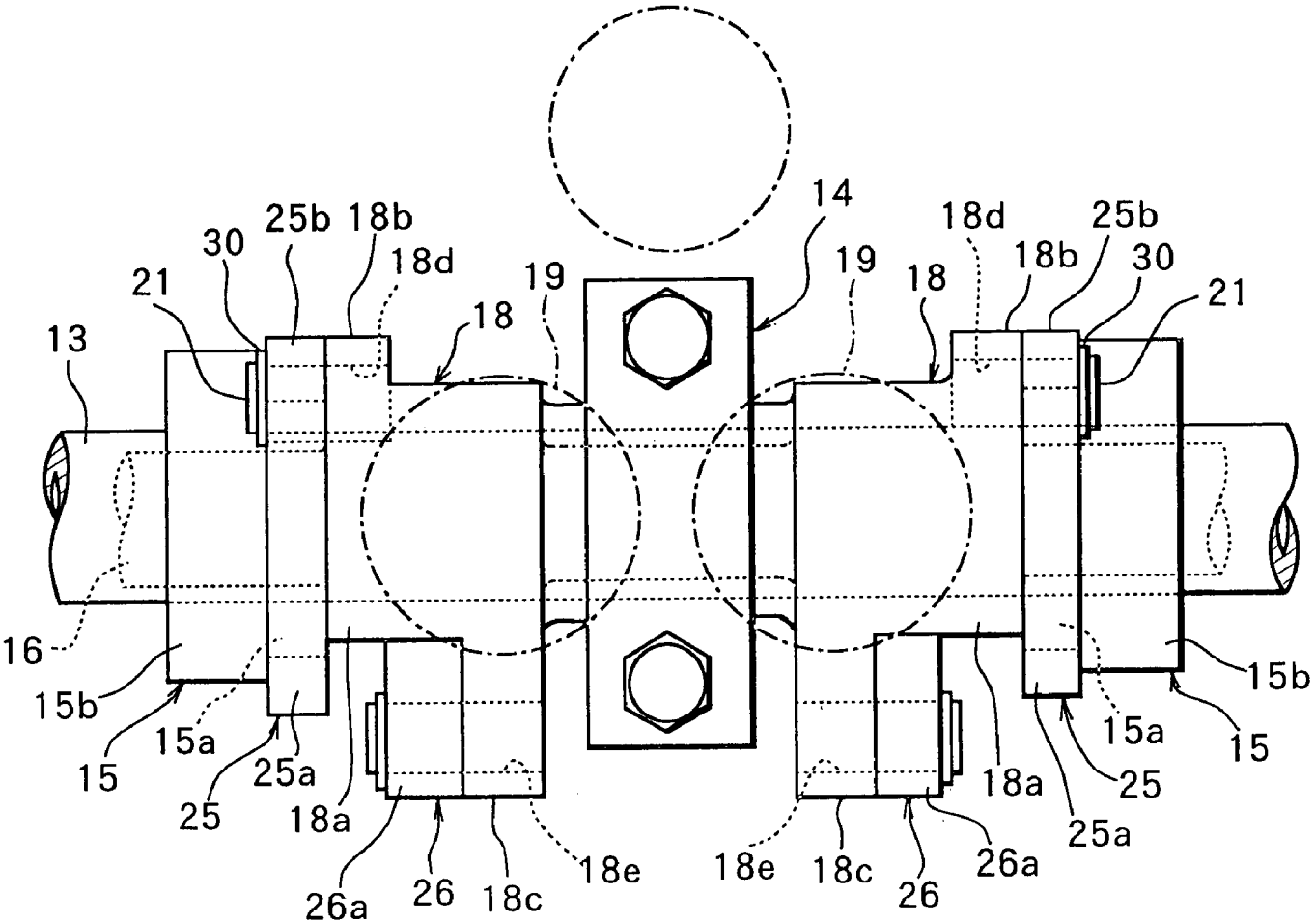
FIG. 4 is a top plan view of the variable valve event and lift mechanism.

FIG. 2 to FIG. 4 show in detail the structure of variable valve event and lift mechanism 112.

Variable valve event and lift mechanism 112 shown in FIG. 2 to FIG. 4 includes a pair of intake valves 105, 105, a hollow camshaft (drive shaft) 13 rotatably supported by a cam bearing 14 of a cylinder head 11, two eccentric cams (drive cams) 15, 15 axially supported by camshaft 13, a control shaft 16 rotatably supported by cam bearing 14 and arranged at an upper position of camshaft 13, a pair of rocker arms 18,18 swingingly supported by control shaft 16 through a control cam 17, and a pair of swing cams 20, 20 independent of each other disposed to upper end portions of intake valves 105, 105 through valve lifters 19, 19, respectively.

Eccentric cams 15, 15 are connected with rocker arms 18, 18 by link arms 25, 25, respectively. Rocker arms 18,18 are connected with swing cams 20, 20 by link members 26, 26.

Rocker arms 18, 18, link arms 25, 25, and link members 26, 26 constitute a transmission mechanism.

Figure 5:
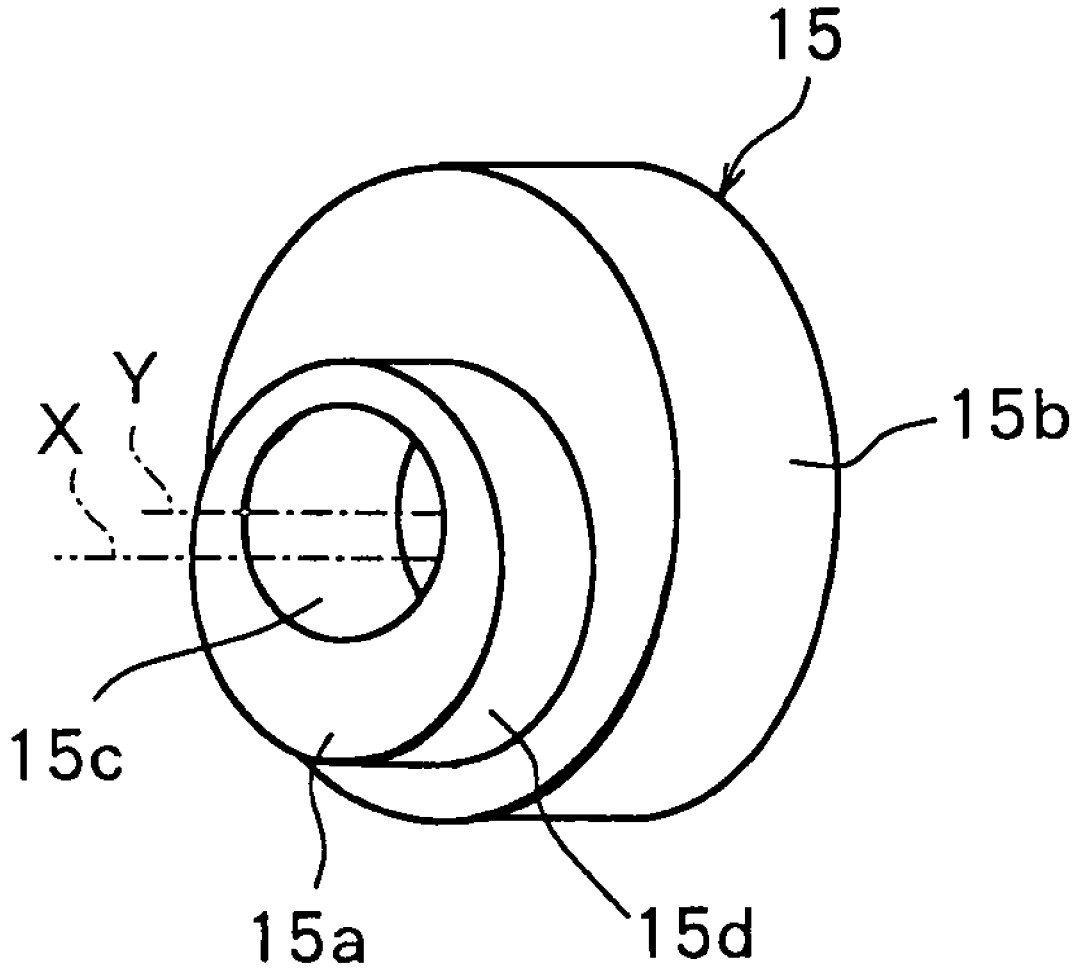
FIG. 5 is a perspective view showing an eccentric cam for use in the variable valve event and lift mechanism.

Each eccentric cam 15, as shown in FIG. 5, is formed in a substantially ring shape and includes a cam body 15*a* of small diameter, a flange portion 15*b* integrally formed on an outer surface of cam body 15*a*. A camshaft insertion hole 15*c* is formed through the interior of eccentric cam 15 in an axial direction, and also a center axis X of cam body 15*a* is biased from a center axis Y of camshaft 13 by a predetermined amount.

Eccentric cams 15, 15 are pressed and fixed to camshaft 13 via camshaft insertion holes 15*c* at outsides of valve lifters 19, 19, respectively, so as not to interfere with valve lifters 19, 19. Also, outer peripheral surfaces 15*d*, 15*d* of cam body 15*a* are formed in the same cam profile.

Each rocker arm 18, as shown in FIG. 4, is bent and formed in a substantially crank shape, and a central base portion 18*a* thereof is rotatably supported by control cam 17.

A pin hole 18*d* is formed through one end portion 18*b* which is formed to protrude from an outer end portion of base portion 18*a*. A pin 21 to be connected with a tip portion of link arm 25 is pressed into pin hole 18*d*. A pin hole 18*e* is formed through the other end portion 18*c* which is formed to protrude from an inner end portion of base portion 18*a*. A pin 28 to be connected with one end portion 26*a* (to be described later) of each link member 26 is pressed into pin hole 18*e*.

Control cam 17 is formed in a cylindrical shape and fixed to a periphery of control shaft 16. As shown in FIG. 2, a center axis P1 position of control cam 17 is biased from a center axis P2 position of control shaft 16 by $\alpha$.

Swing cam 20 is formed in a substantially lateral U-shape as shown in FIGS. 2, 6A, 6B, 7A, and 7B. A supporting hole 22*a* is formed through a substantially ring-shaped base end portion 22. Camshaft 13 is inserted into supporting hole 22*a* to be rotatably supported. Also, a pin hole 23*a* is formed through an end portion 23 positioned at the other end portion 18c of rocker arm 18.

A base circular surface 24*a* of base end portion 22 side and a cam surface 24*b* extending in an arc shape from base circular surface 24*a* to an edge of end portion 23, are formed on a bottom surface of swing cam 20. Base circular surface 24*a* and cam surface 24*b* are in contact with a predetermined position of an upper surface of each valve lifter 19 corresponding to a swing position of swing cam 20.

Figure 8:
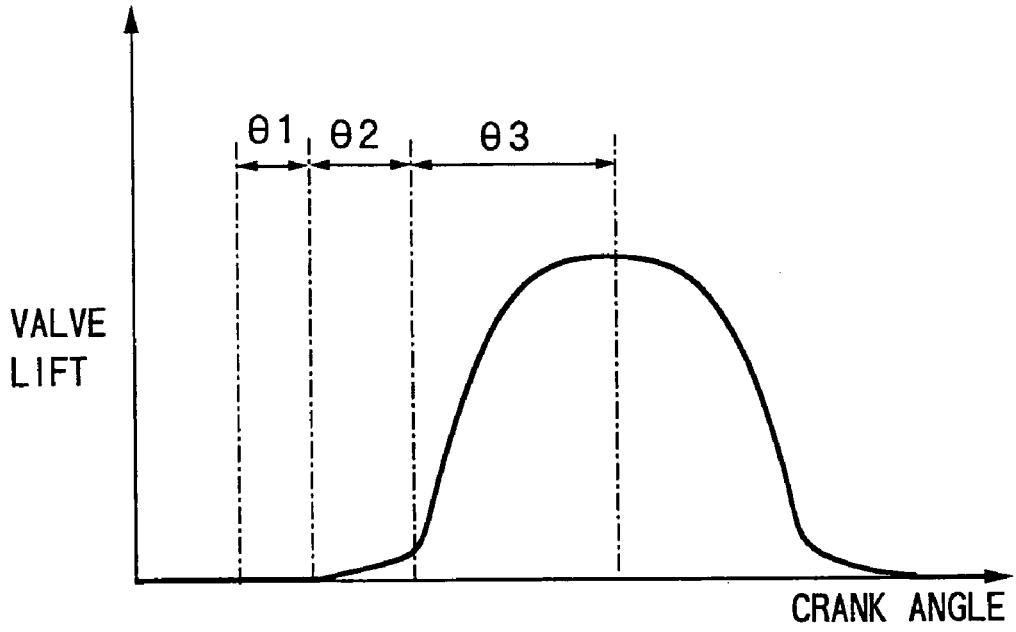
FIG. 8 is a valve lift characteristic diagram corresponding to a base end face and a cam surface of a swing cam in the variable valve event and lift mechanism.

Namely, according to a valve lift characteristic shown in FIG. 8, as shown in FIG. 2, a predetermined angle range $\theta$1 of base circular surface 24*a* is a base circle interval and a range of from base circle interval $\theta$1 of cam surface 24*b* to a predetermined angle range $\theta$2 is a so-called ramp interval, and a range of from ramp interval $\theta$2 of cam surface 24*b* to a predetermined angle range $\theta$3 is a lift interval.

Link arm 25 includes a ring-shaped base portion 25*a* and a protrusion end 25*b* protrudingly formed on a predetermined position of an outer surface of base portion 25*a*. A fitting hole 25*c* to be rotatably fitted with the outer surface of cam body 15*a* of eccentric cam 15 is formed on a central position of base portion 25*a*. Also, a pin hole 25*d* into which pin 21 is rotatably inserted is formed through protrusion end 25*b*.

Link member 26 is formed in a linear shape of predetermined length and pin insertion holes 26*c*, 26*d* are formed through both circular end portions 26*a*, 26*b*. End portions of pins 28, 29 pressed into pin hole 18*d* of the other end portion 18*c* of rocker arm 18 and pin hole 23*a* of end portion 23 of swing cam 20, respectively, are rotatably inserted into pin insertion holes 26*c*, 26*d*.

Snap rings 30, 31, 32 restricting axial transfer of link arm 25 and link member 26 are disposed on respective end portions of pins 21, 28, 29.

Figure 6:
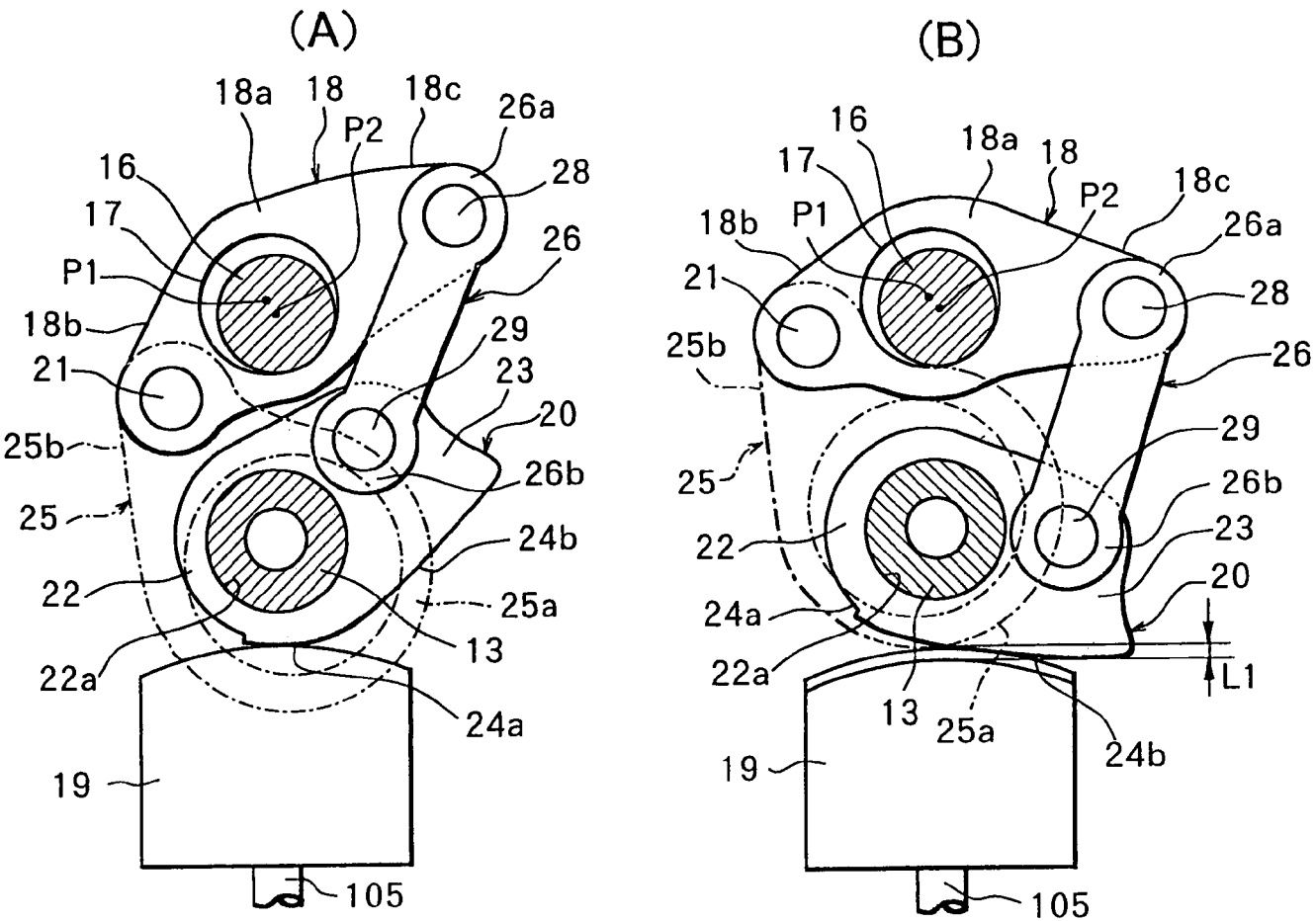
FIGS. 6A and 6B are cross-sectional views that show an operation of the variable valve event and lift mechanism at a low lift condition (B—B cross section view of FIG. 3).
Figure 7:
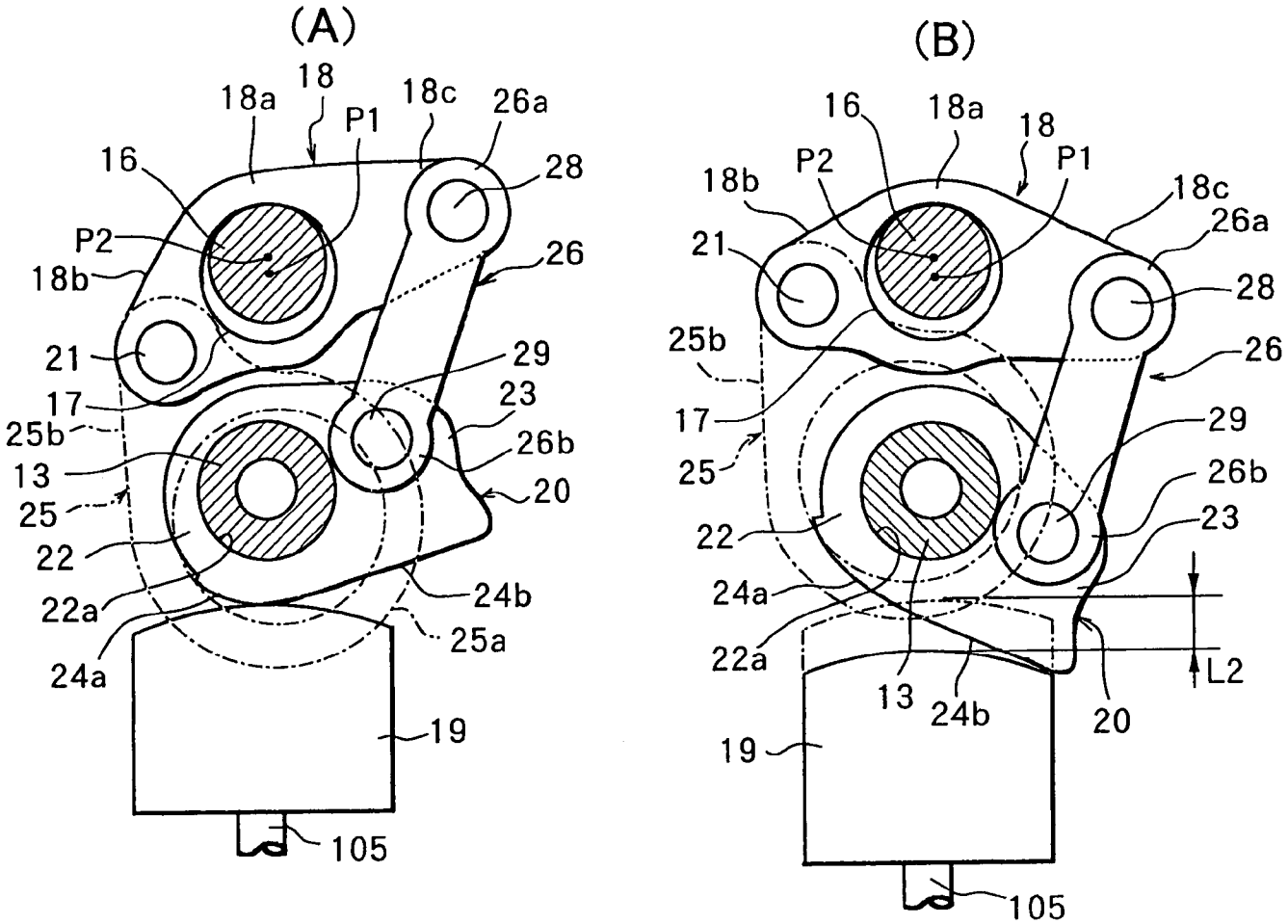
FIG. 7 is a cross section view showing an operation of the variable valve event and lift mechanism at a high lift condition (B—B cross section view of FIG. 3).

In such a constitution, depending on a positional relation between the center axis P2 of control shaft 16 and the center axis P1 of control cam 17, as shown in the low lift L1 configuration shown in FIG. 6B and the high lift L2 configuration shown in FIG. 7B, the valve lift amount is varied. By driving control shaft 16 to rotate, the position of the center axis P2 of control shaft 16 relative to the center axis P1 of control cam 17 is changed.

Figure 9:
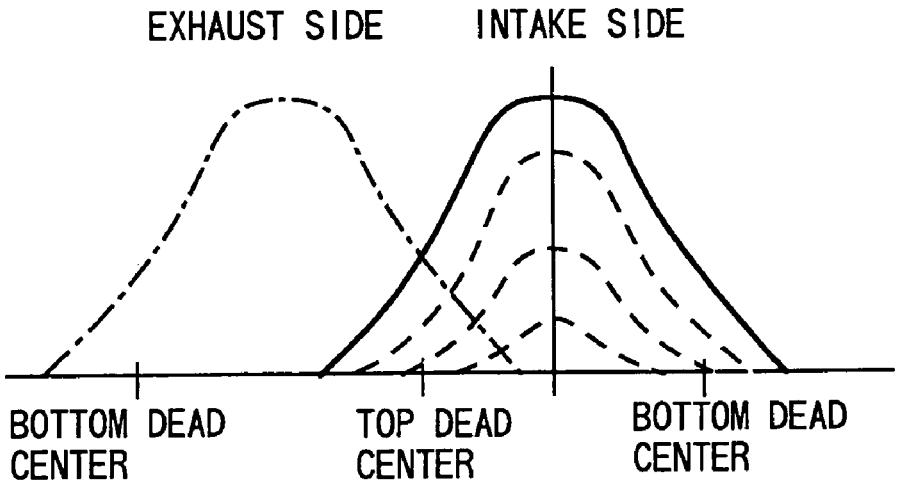
FIG. 9 is a characteristic diagram showing valve timing and a valve lift of the variable valve event and lift mechanism.
Figure 10:
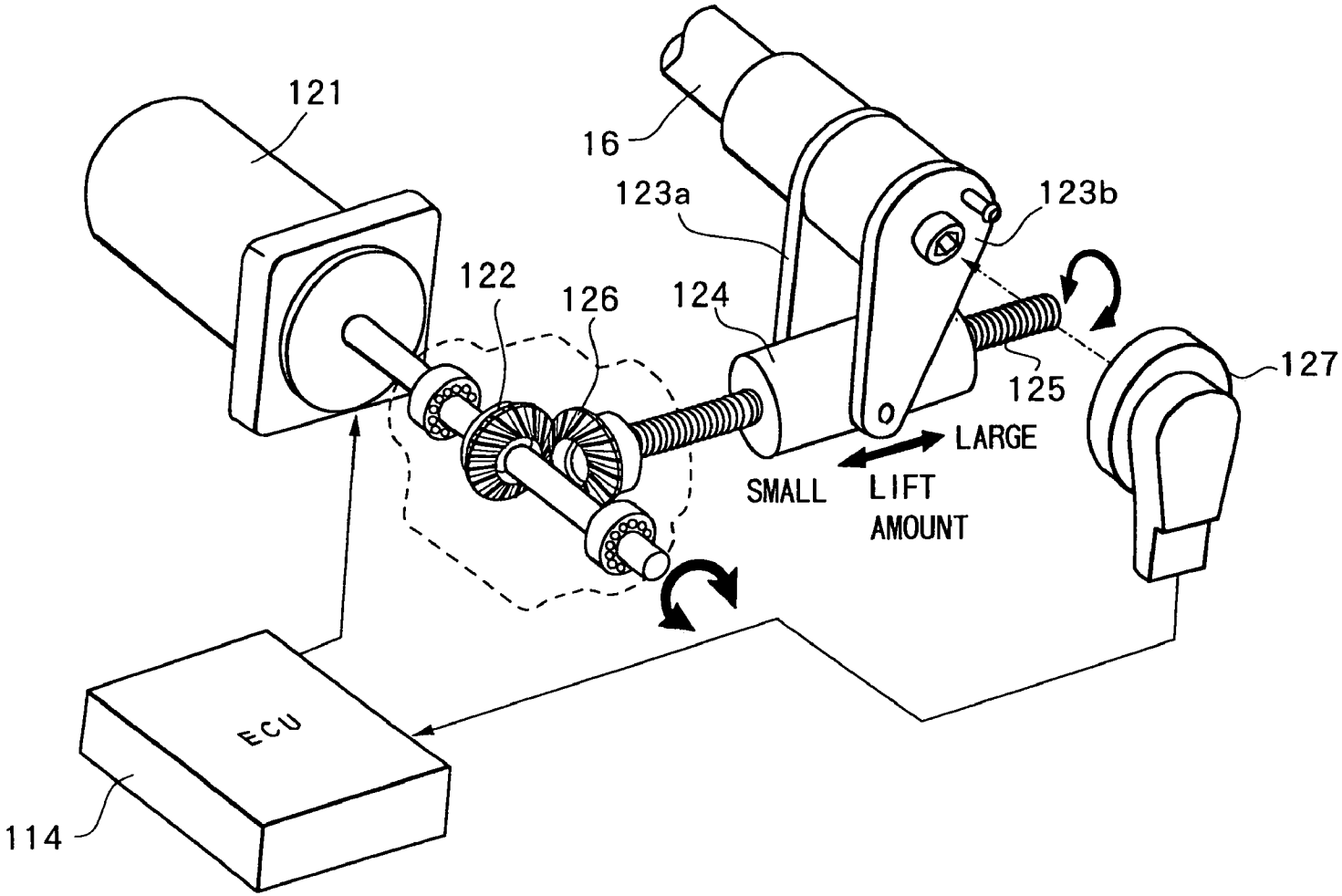
FIG. 10 is a perspective view showing a rotational driving mechanism of a control shaft in the variable valve event and lift mechanism.

Control shaft 16 is driven to rotate within a predetermined rotation angle range by a DC servo motor (actuator) 121 as shown in FIG. 10. By varying an operating angle of control shaft 16 by DC servo motor 121, the valve lift amount and valve operating angle of intake valve 105 are successively varied (refer to FIG. 9).

In FIG. 10, DC servo motor 121 is arranged so that the rotation shaft thereof is parallel to control shaft 16, and a bevel gear 122 is axially supported by the tip portion of the rotation shaft.

On the other hand, a pair of stays 123*a*, 123*b* are fixed to the tip end of control shaft 16. A nut 124 is swingingly supported around an axis parallel to control shaft 16 connecting the tip portions of the pair of stays 123*a*, 123*b*.

A bevel gear 126 meshed with bevel gear 122 is axially supported at the tip end of a threaded rod 125 engaged with nut 124. Threaded rod 125 is rotated by the rotation of DC servo motor 121, and the position of nut 124 engaged with threaded rod 125 is displaced in an axial direction of threaded rod 125, so that control shaft 16 is rotated.

Here, the valve lift amount is decreased as the position of nut 124 approaches bevel gear 126, while the valve lift amount is increased as the position of nut 124 moves away from bevel gear 126.

Further, a potentiometer type operating angle sensor 127 detecting the operating angle of control shaft 16 is disposed on the tip end of control shaft 16, as shown in FIG. 10. Control unit 114 feedback controls DC servo motor 121 so that an actual operating angle detected by operating angle sensor 127 coincides with a target operating angle. Here, as mentioned above, since the valve lift amount and the valve operating angle can be varied simultaneously, operating angle sensor 127 detects the valve operating angle and at the same time the valve lift amount.

The intake air amount is controlled by varying the valve operating characteristic of intake valve 105 by such a variable valve event and lift mechanism as described above. In the present invention, a control speed of intake valve 105 is changed so that a desired engine power torque response can be obtained according to engine operating conditions.

There will be described a first embodiment of the intake air amount control to be performed by control unit 114 while changing the control speed of intake valve 105 according to the engine operating conditions, in accordance with a block diagram in FIG. 11.

In block 1 (denoted as B1 in the drawings. Likewise for all blocks), a target operating angle TGVEL0 of intake valve 105 corresponding to a target torque is set based on the accelerator opening ACC detected by accelerator pedal sensor 116 and an engine rotation speed Ne detected by crank angle sensor 117.

In block 2, there is set a weighting factor KAJU for the newest target operating angle TGVEL0 (corresponding to the present operating condition) in weighted mean calculation (to be described later) for determining the control speed based on the engine rotation speed Ne. Here, the weighting factor KAJU is set to 1 in a high speed region as shown in the figure, but is set to become smaller as the engine rotation speed becomes lower.

In block 3, the weighting factor KAJU is multiplied on the target operating angle TGVEL0.

On the other hand, in block 5, the weighting factor KAJU is subtracted from the constant 1 output from block 4, and the weighting factor (=1−KAJU) for a previous value TGVELz of target operating angle is calculated.

In block 6, the previous value TGVELz of target operating angle is calculated, and in block 7, the weighting factor (=1−KAJU) is multiplied on the previous value TGVELz.

In block 8, the value calculated in block 3 and the value calculated in block 7 are added together. That is, the value obtained by multiplying the weighting factor KAJU on the newest target operating angle TGVEL0, and the value obtained by multiplying the weighting factor (=1−KAJU) on the previous value TGVELz are added together, to calculate a weighted mean value as a final target operating angle TGVEL (refer to the following equation).

$$TGVEL = TGVEL0 \times KAJU + TGVELz \times (1 - KAJU)$$

In block 9, controlled variable VELDUTY is set by a PID control based on the target operating angle TGVEL and an actual operating angle VELCOM detected by operating angle sensor 127, to be output to DC sevo motor 121.

According to the above constitution, in the high speed region, since the weighting factor for the newest target operating angle TGVEL0 is KAJU=1 and the weighting factor for the previous value TGVELz is (1−KAJU)=0, the weighted mean calculation is not substantially performed and consequently, the newest target operating angle TGVEL0 is output just as it is, as the final target operating angle TGVEL. On the contrary, since the weighting factor KAJU is decreased and the weighting factor (1−KAJU) is increased as the engine rotation speed is decreased, the output of the target operating angle TGVEL is largely delayed to the output of the newest target operating angle TGVEL0.

Figure 12:
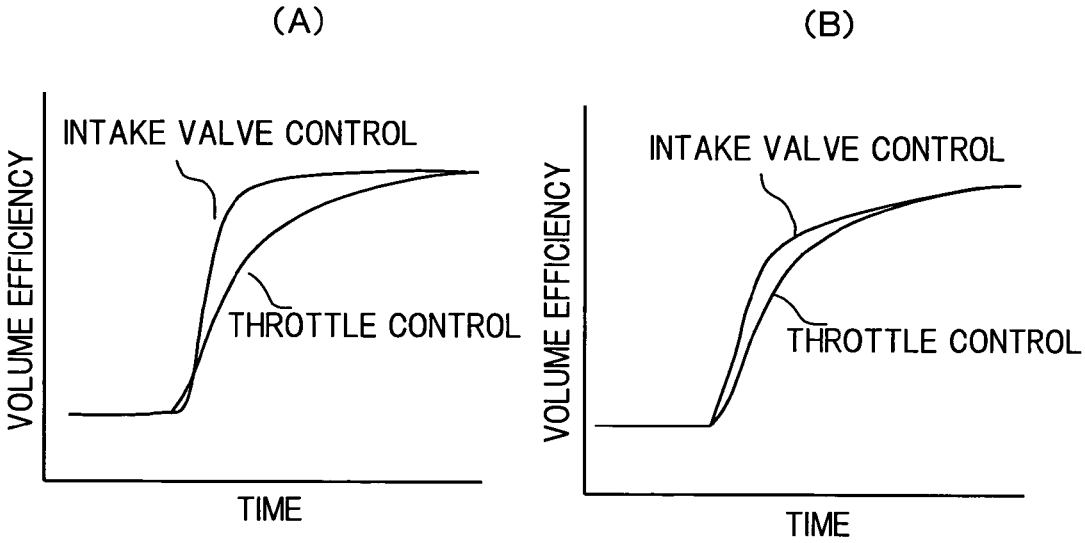

FIGS. 12A and 12B show response characteristics of volume efficiencies in the throttle control and the intake valve control at the time of high speed (FIG. 12A) and at the time of low speed (FIG. 12B). As apparent from the figures, as the suction of the intake air of the amount for collector capacity into the cylinder finishes quickly at the time of high speed, the response characteristic to converge on the target volume efficiency in the throttle control is equivalent to that in the intake valve control. However, as it requires time to suck the intake air of the amount for collector capacity into the cylinder at the time of low speed, the response characteristic in the throttle control is largely delayed to that in the intake valve control. In other words, the response in the intake valve control is too quick, to thereby degrade the drivability.

Consequently, as in the present embodiment, at the time of low speed, the output of target operating angle TGVEL is made to be delayed largely, so that the output of the actually controlled operating angle VELCOM is largely delayed. Thus, the response characteristic closer to that in the throttle control can be obtained, to achieve the drivability coping with a driver's request. Further, since the operation of accelerator can be facilitated, the drivability during running can be improved even in this point.

Figure 13:
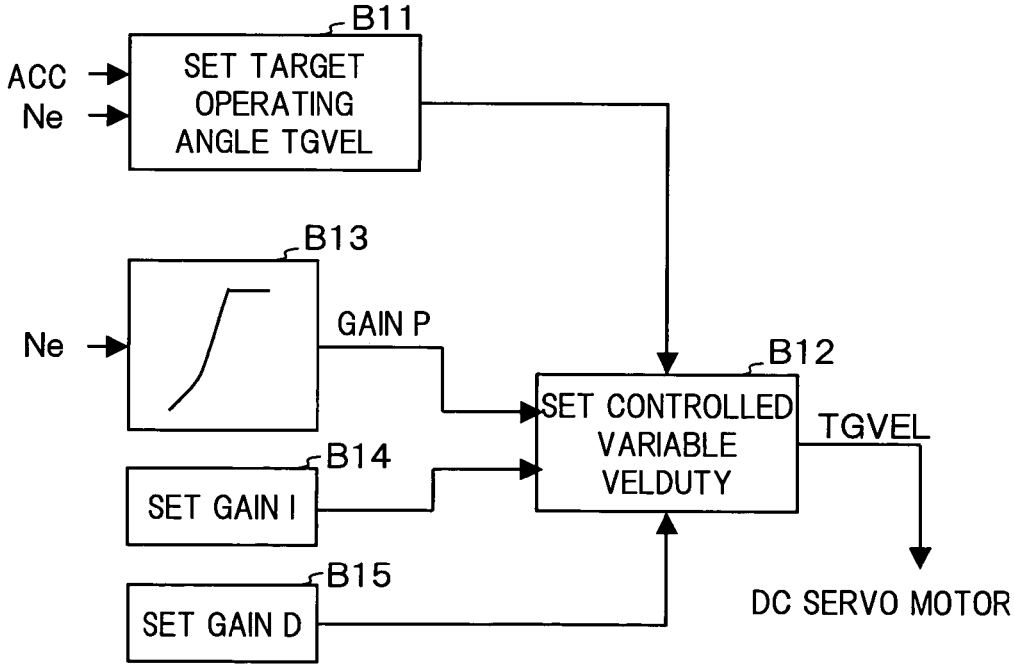
FIG. 13 is a block diagram of an intake valve control in a second embodiment.

Next, a second embodiment will be described in accordance with a block diagram in FIG. 13.

In the first embodiment, the constitution is such that the output of the target operating angle is delayed, to change the control speed. However, in the second embodiment, the output of the controlled variable is directly delayed, to change the control speed.

Figure 11:
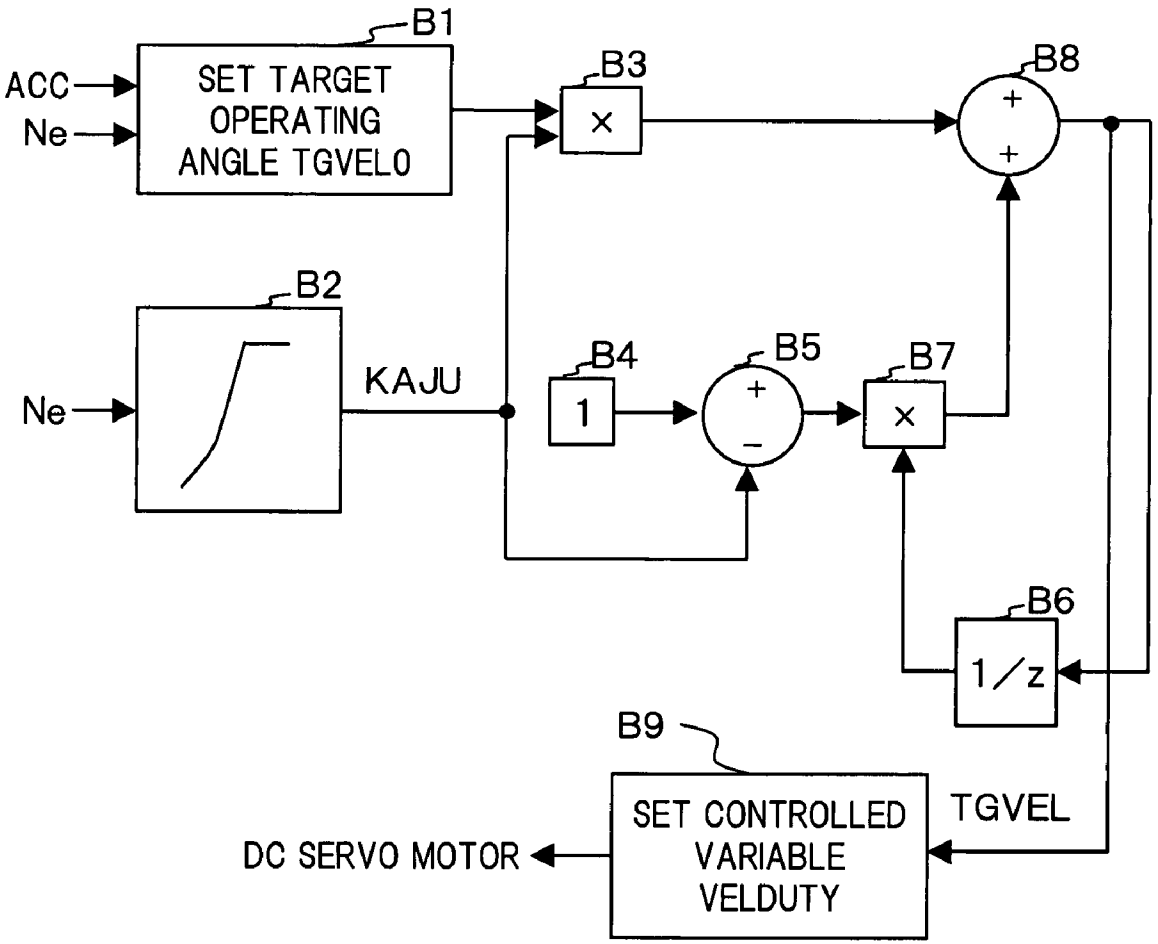
FIG. 11 is a block diagram of an intake valve control in a first embodiment.

In block 11, in the same manner of block 1 in FIG. 11, the target operating angle TGVEL is set based on the accelerator opening and the engine rotation speed. This target operating angle TGVEL is input just as it is to block 12 for setting the controlled variable VELDUTY by the PID control.

On the other hand, in block 13, a proportional gain P in the PID control is set based on the engine rotation speed Ne. Here, the proportional gain P is set to become smaller as the engine rotation speed becomes lower, as shown in the figure.

The proportional gain P is variably set based on the engine rotation speed Ne as described above, a constant integral gain I and a constant differential gain D set in blocks 14 and 15, respectively, are input to block 12.

Then, in block 12, the controlled variable VELDUTY is set by the PID control using the proportional gain P, the integral gain I and the differential gain D, based on the target operating angle TGVEL and the actual operating angle VELCOM detected by operating angle sensor 127, to be output to DC servo motor 121.

Thus, the output of the controlled variable VELDUTY is set to be largely delayed by the proportional gain P, which is set to be small at the time of low speed, so as to delay the convergence on the target operating angle. Accordingly, as in the first embodiment, as the output of the actually controlled operating angle VELCOM is largely delayed, the response characteristic closer to that in the throttle control can be obtained. As a result, a good drivability (starting or accelerating/decelerating ability) that corresponds to the driver's request can be obtained. Moreover, the operation of accelerator can be facilitated, thereby improving the drivability during running.

Further, in the above embodiments, the constitution is such that the control speed of the intake valve is changed based on the engine rotation speed, so as to correspond to the response of engine power torque. However, the constitution may be such that the control speed is changed using directly the detection value of engine power torque.

Figure 14:
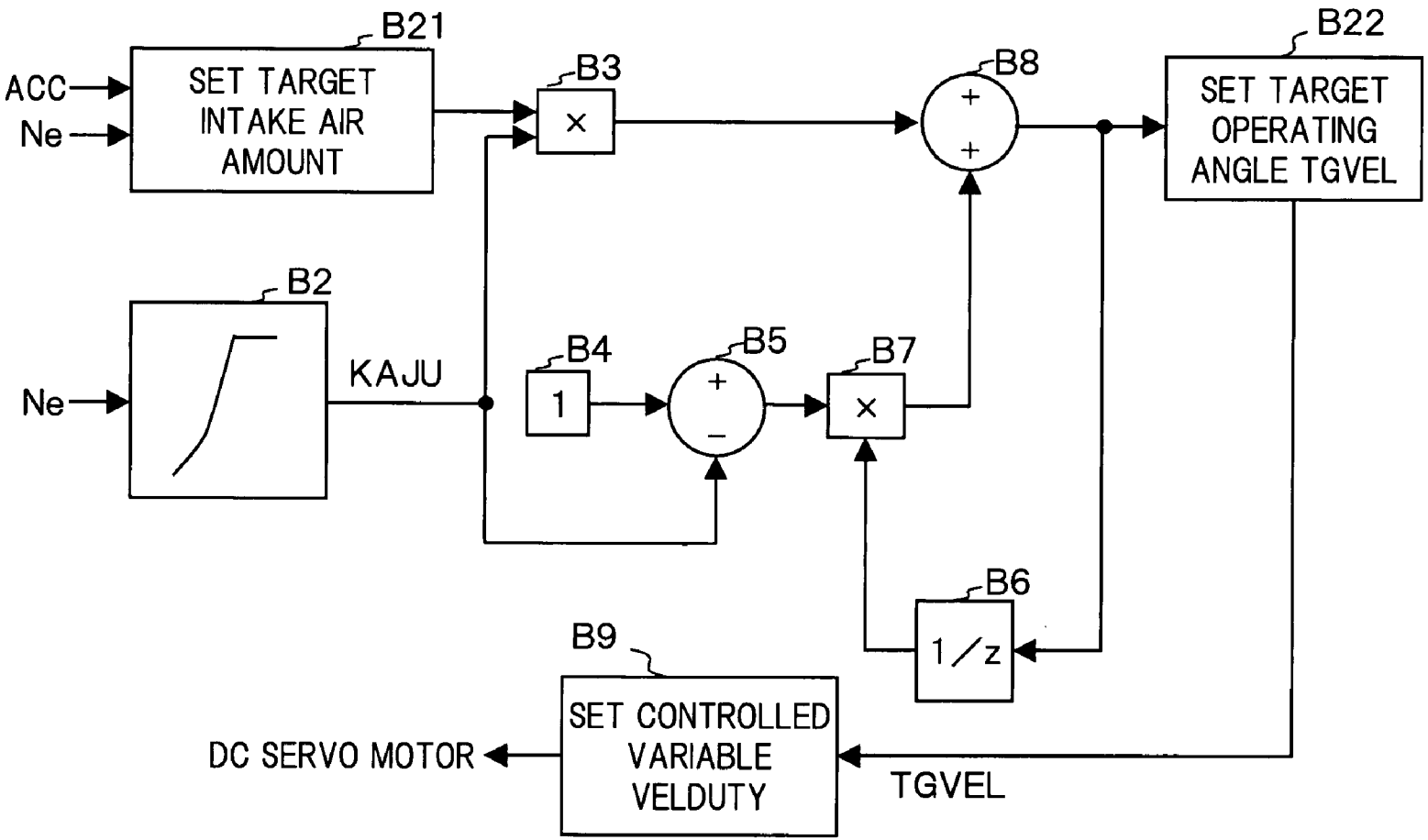
FIG. 14 is a block diagram of an intake valve control in a third embodiment.

Moreover, as shown in FIG. 14, the constitution may be such that a target intake air amount equivalent to the target torque is set based on the accelerator opening ACC and the engine rotation speed Ne. The target intake air amount is corrected to be delayed, so that the target operating angle is calculated based on the corrected target intake air amount. Thus, the lift amount control of intake valve can be performed finely.

The entire contents of Japanese Patent Applications No. 2002-328593 and No. 2003-339720, filed Nov. 12, 2002 and Sep. 30, 2003, respectively, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

What is claimed are:

1. A variable valve control apparatus in an internal combustion engine, that varies an open/close characteristic of an intake valve, comprising:

an intake side variable valve mechanism that varies the open/close characteristic of said intake valve;

an operating condition detector detecting operating conditions of the internal combustion engine; and a control unit that receives a detection signal from said operating condition detector, and outputs a control signal to said intake side variable valve mechanism based on said detection signal, wherein said control unit is configured to:

determine a target open/close characteristic and a control speed of the intake valve at a time when the intake valve is controlled to have said target open/close characteristic, based on the operating conditions of the internal combustion engine, to control said intake side variable valve mechanism; and make said control speed of the intake valve to be lower in the engine operating condition where a response of engine power torque to a change in the open/close characteristic of the intake valve is quick, as compared to the engine operating condition where the response of engine power torque to a change in the open/close characteristic of the intake valve is slow.

2. A variable valve control apparatus in an internal combustion engine according to claim 1, wherein the engine operating condition where said response of engine power torque is quick is a condition where an engine rotation speed is a predetermined speed or less.

3. A variable valve control apparatus in an internal combustion engine according to claim 1, wherein said control unit corrects the control signal to be output to said intake side variable valve mechanism, to change said control speed.

4. A variable valve control apparatus in an internal combustion engine according to claim 1, wherein said control unit corrects the target operating characteristic of said intake valve, to change said control speed.

5. A variable valve control apparatus in an internal combustion engine according to claim 1, wherein said control unit sets the target operating characteristic of said intake valve based on a target intake air amount.

6. A variable valve control apparatus in an internal combustion engine according to claim 5, wherein said control unit corrects said target intake air amount to be delayed, to change said control speed based on the corrected target intake air amount.

7. A variable valve control apparatus in an internal combustion engine according to claim 1, wherein said intake side variable valve mechanism comprises a variable valve event and lift mechanism that varies a valve lift amount and a valve operating angle of said intake valve.

8. A variable valve control apparatus in an internal combustion engine according to claim 7, wherein said variable valve event and lift mechanism comprises:

a drive shaft rotating in synchronism with a crankshaft;

a drive cam fixed to said drive shaft;

a swing cam swinging to operate said intake valve to open and close;

a transmission mechanism with one end connected to said drive cam and the other end connected to said swing cam;

a control shaft having a control cam changing the position of said transmission mechanism; and an actuator rotating said control shaft, and wherein said variable valve event and lift mechanism successively varies the valve lift amount together with the valve operating angle by rotatably controlling said control shaft by said actuator.

9. A variable valve control apparatus in an internal combustion engine, that varies an open/close characteristic of an intake valve, comprising:

intake side variable valve means for varying the open/close characteristic of said intake valve;

operating condition detecting means for detecting operating conditions of the internal combustion engine; and intake valve control means being configured to:

determine a target open/close characteristic and a control speed of the intake valve at a time when the intake valve is controlled to have said target open/close characteristic, based on the operating conditions of the internal combustion engine, to control said intake side variable valve means; and make said control speed of the intake valve to be lower in the engine operating condition where a response of engine power torque to a change in the open/close characteristic of the intake valve is quick, as compared to the engine operating condition where the response of engine power torque to a change in the open/close characteristic of the intake valve is slow.

10. A variable valve control method in an internal combustion engine, for controlling an intake side variable valve mechanism that varies an open/close characteristic of an intake valve, comprising the steps of:

detecting operating conditions of the internal combustion engine;

determining a target open/close characteristic and a control speed of said intake valve at a time when the intake valve is controlled to have said target open/close characteristic, based on the operating conditions of the internal combustion engine, said step of determining a control speed of the intake valve comprising the step of:

making said control speed of the intake valve to be lower in the engine operating condition where a response of engine power torque to a change in the open/close characteristic of the intake valve is quick, as compared to the engine operating condition where the response of engine power torque to a change in the open/close characteristic of the intake valve is slow; and controlling said intake side variable valve mechanism based on said target open/close characteristic and said control speed.

11. A variable valve control method in an internal combustion engine according to claim 10, wherein said engine operating condition where said response of engine power torque is quick is a condition where an engine rotation speed is a predetermined speed or less.

12. A variable valve control method in an internal combustion engine according to claim 10, wherein said step of determining a control speed of the intake valve corrects the control signal to be output to said intake side variable valve mechanism, to change said control speed.

13. A variable valve control method in an internal combustion engine according to claim 10, wherein said step of determining a control speed of the intake valve corrects the target operating characteristic of the intake valve, to change said control speed.

14. A variable valve control method in an internal combustion engine according to claim 10, wherein said step of determining a target operating characteristic of the intake valve sets the target operating characteristic of the intake valve based on a target intake air amount.

15. A variable valve control method in an internal combustion engine according to claim 14, wherein said step of determining a control speed of the intake valve corrects said target intake air amount to be delayed, to change said control speed based on the corrected target intake air amount.

* * * * *